United States Patent [19]

Camosso et al.

[11] Patent Number: 4,632,075

[45] Date of Patent: Dec. 30, 1986

[54] OILTIGHT HYDRAULIC TAPPET FOR CONTROLLING AN INTERNAL COMBUSTION ENGINE VALVE

[75] Inventors: Domenico Camosso; Franco Colanzi, both of Turin; Silvio Ragazzoni, Pino Torinese, all of Italy

[73] Assignee: RIV-SKF Officine di Villar Perosa S.p.A., Italy

[21] Appl. No.: 755,141

[22] Filed: Jul. 8, 1985

[30] Foreign Application Priority Data

Jul. 24, 1984 [IT] Italy ..... 67741 A/84

[51] Int. Cl.[4] ..... F01L 1/24

[52] U.S. Cl. ..... 123/90.58; 123/90.55

[58] Field of Search ..... 123/90.58, 90.55, 90.56, 123/90.57, 90.46, 90.59

[56] References Cited

U.S. PATENT DOCUMENTS

| | | | |
|---|---|---|---|
| 2,109,815 | 3/1938 | Best | 123/90.58 |
| 2,833,257 | 5/1958 | Lengnick | 123/90.58 |
| 3,495,577 | 2/1970 | Collins | 123/90.58 |
| 3,521,608 | 7/1970 | Scheibe | 123/90.58 |
| 4,397,271 | 8/1983 | Gardner | 123/90.58 |

FOREIGN PATENT DOCUMENTS

| | | | |
|---|---|---|---|
| 146210 | 11/1980 | Japan | 123/90.58 |
| 160106 | 12/1980 | Japan | 123/90.58 |
| 2089923 | 6/1982 | United Kingdom | 123/90.55 |

*Primary Examiner*—Ira S. Lazarus

*Attorney, Agent, or Firm*—Jeffers, Irish & Hoffman

[57] ABSTRACT

Hydraulic tappet essentially comprising a first cup member sliding in a seat; a second member sliding axially in relation to the first; a third annular member located inside the said first cup member and having a sleeve, inside the inner bore of which the said second member slides axially, and a ring projecting radially from the said sleeve and connected in fluidtight manner to the side wall on the said first cup member in such a manner as to form a first chamber for fluid under pressure; and a fourth annular member made of flexible material and located essentially inside the said first cup member and outside the said sleeve on the said third annular member in such a manner as to form a second activating fluid chamber connected hydraulically to the said first chamber over a duct with an on-off member.

8 Claims, 3 Drawing Figures

OILTIGHT HYDRAULIC TAPPET FOR CONTROLLING AN INTERNAL COMBUSTION ENGINE VALVE

BACKGROUND OF THE INVENTION

The present invention relates to a hydraulic tappet designed for assembly on a drive for controlling an internal combustion engine valve.

Hydraulic tappets of the aforementioned type are generally known to comprise a first member, sliding in relation to the engine frame, and a second member sliding axially in relation to the said first member. Between the said two members is formed a chamber varying in volume and having and inlet duct for activating fluid, the opening on the said duct being controlled by an on-off member in such a manner that the said fluid flowing into the said chamber causes one of the said members to move axially in relation to the other so as to vary the volume of the said chamber and so take up any slack on the said drive gear train.

The said variable-volume chamber normally communicates through ducts with an appropriate source of activating fluid from the engine.

A major drawback on tappets of the aforementioned type is that they perform badly when the engine is started up, owing to the fact that the oil inside the said chamber prior to start-up seeps out between the mating surfaces on the said first and second sliding members, and that, during start-up, the oil pressure on the engine is too low to ensure adequate oil supply to the said chamber. On certain known tappets, the aforementioned drawbacks have been partially solved by providing for a second activating fluid chamber communicating hydraulically with the first and designed to store a certain amount of fluid even when the engine is idle, thus enabling the first chamber to be filled with fluid more easily, as compared with the previous arrangement, when the engine is started up.

On these tappets, however, long-term operation of the engine may result in such severe oil leakage from the second chamber as to jeopardize operation of the tappet; such leakage occurring between the mutually-sliding mating surfaces on the said two sliding members, despite the same being provided with appropriate sealing members.

SUMMARY OF THE INVENTION

The aim of the present invention is to provide a hydraulic tappet of the aforementioned type involving none of the aforementioned drawbacks, i.e. one providing for a high degree of reliability, good performance even during start-up, and requiring no maintenance. The tappet according to the present invention is also highly compact, straightforward in design and therefore cheap to make. With this aim in view, the present invention relates to a hydraulic tappet designed for assembly on a drive for controlling a valve on an internal combustion engine, the said tappet comprising a first cup member having a bottom wall and a cylindrical side wall and sliding axially in relation to the engine frame, and a second member sliding axially inside the said first member; the said first and second members combining to form a first chamber varying in volume and having an inlet duct for activating fluid, the said duct being controlled by an on-off member in such a manner that the said fluid flowing into the said chamber causes one of the said members to slide axially in relation to the other so as to vary the volume of the said chamber; characterized by the fact that it comprises a third annular member having a sleeve, inside the inner bore of which the said second member slides axially, and a ring projecting radially from the said sleeve and connected in fluidtight manner to the said side wall on the said first cup member in such a manner as to form the said first chamber between the said ring and the said bottom and side walls on the said first cup member, and characterized by the fact that it comprises a fourth member made of flexible material and located essentially inside the said first cup member and outside the said sleeve on the said third annular member, the said fourth flexible annular member having a first and second annular edge connected in fluidtight manner respectively to the said ring on the said third member and to the side surface of the said second sliding member in such a manner as to form a second annular chamber for the said activating fluid connected hydraulically, via the said duct, to the said first chamber.

BRIEF DESCRIPTION OF THE DRAWINGS

The present invention will now be described in more detail, by way of a non-limiting example, with reference to the attached drawings in which.

DETAILED DESCRIPTION OF THE INVENTION

Figure 1:
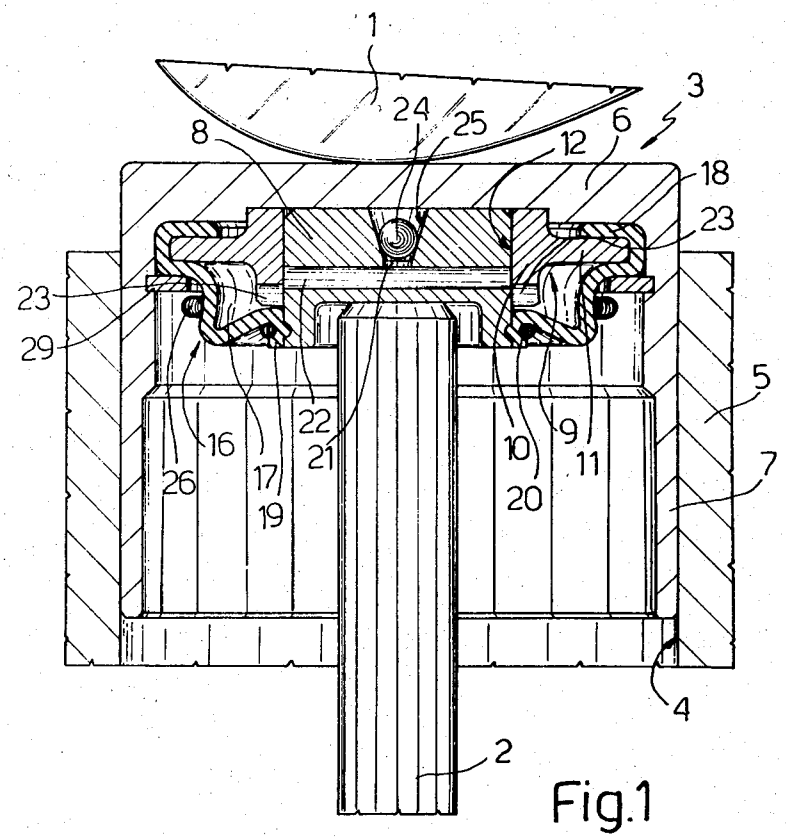
FIG. 1 shows an axial section of a first arrangement of the tappet according to the present invention in a first working position.

The tappet according to the present invention is designed for assembly on a drive for controlling a valve on an internal combustion engine. Of the said drive, FIG. 1 merely shows part of control cam 1 and, of the valve, the end part of stem 2.

The tappet according to the present invention comprises essentially a first cup member 3 sliding inside an essentially cylindrical seat 4 formed inside engine frame 5. The said first member 3 comprises an essentially flat bottom wall 6 designed to contact cam 1, and an essentially cylindrical side wall 7 designed to cooperate with the cylindrical surface of seat 4.

The tappet according to the present invention also comprises a second member 8 sliding axially essentially inside the first cup member 3. Between the said first and second members is located a third annular member 9 essentially comprising a sleeve 10 and a ring 11 connected in fluidtight manner to side wall 7 on first cup member 3. The said second member 8 slides inside centre bore 12 on sleeve 10 so as to form, together with third member 9 and bottom wall 6 on first cup member 3, a first chamber 13 for fluid under pressure. Inside first cup member 3, provision is made for an annular member 16 made of flexible material and designed to form, together with the aforementioned members, a second annular chamber 17 for the said fluid. For this purpose, the said flexible annular member presents a first edge 18 connected in fluidtight manner to ring 11 on third annular member 3. As shown clearly in FIG. 1, the said edge 18 is conveniently secured in fluidtight manner between the said ring and side wall 7 and bottom wall 6 on first cup member 3. A second edge 19 on the said annular member is secured in fluidtight manner, e.g. by means of retraining ring 20, to the outer surface of second member 8.

Between the said first chamber 13 and the said second chamber 17 is formed a duct for enabling hydraulic communication between the said chambers and essentially comprising an axial hole 21 and a radial hole 22, both formed on member 8, and an opening 23 formed on sleeve 10 of third annular member 9. The said duct is fitted with an on-off member which may conveniently consist of a ball 24 housed inside an essentially tapered seat 25.

The tappet according to the present invention also comprises flexible means designed normally to keep flexible member 16 in a flexed position whereby the volume of second chamber 17 is minimum, thus enabling fluid to flow from the said second to the said first chamber. The said flexible means may conveniently consist of an annular spring 26 designed to exert essentially radial pressure on the outer surface of member 16 which is conveniently provided with a number of ribs inside each of which an annular spring may be housed. One such rib is provided in the FIG. 1 arrangement and two in the FIG. 3 arrangement.

Figure 2:
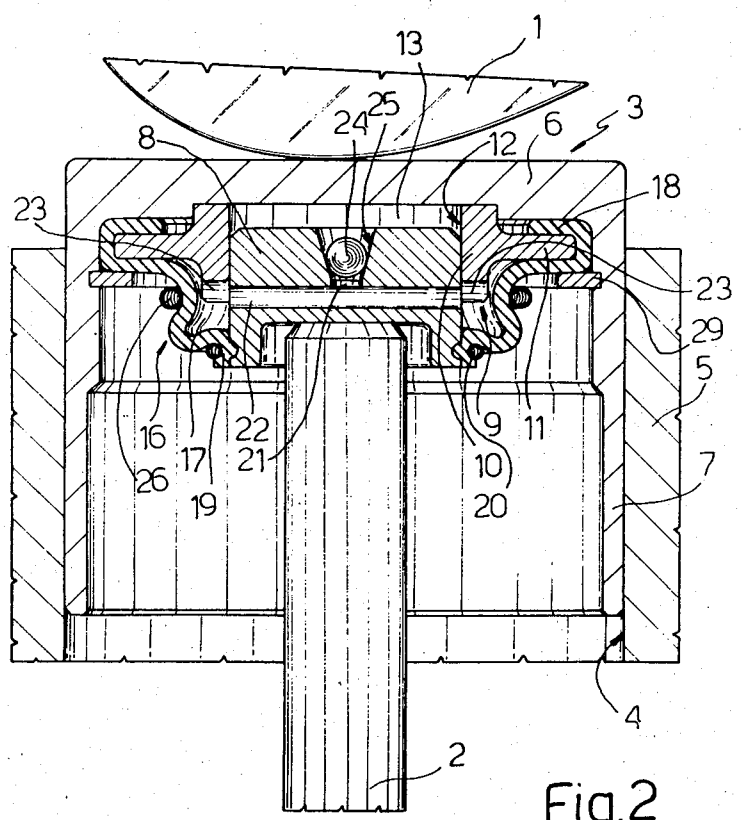
FIG. 2 shows the FIG. 1 tappet in a second working position.
Figure 3:
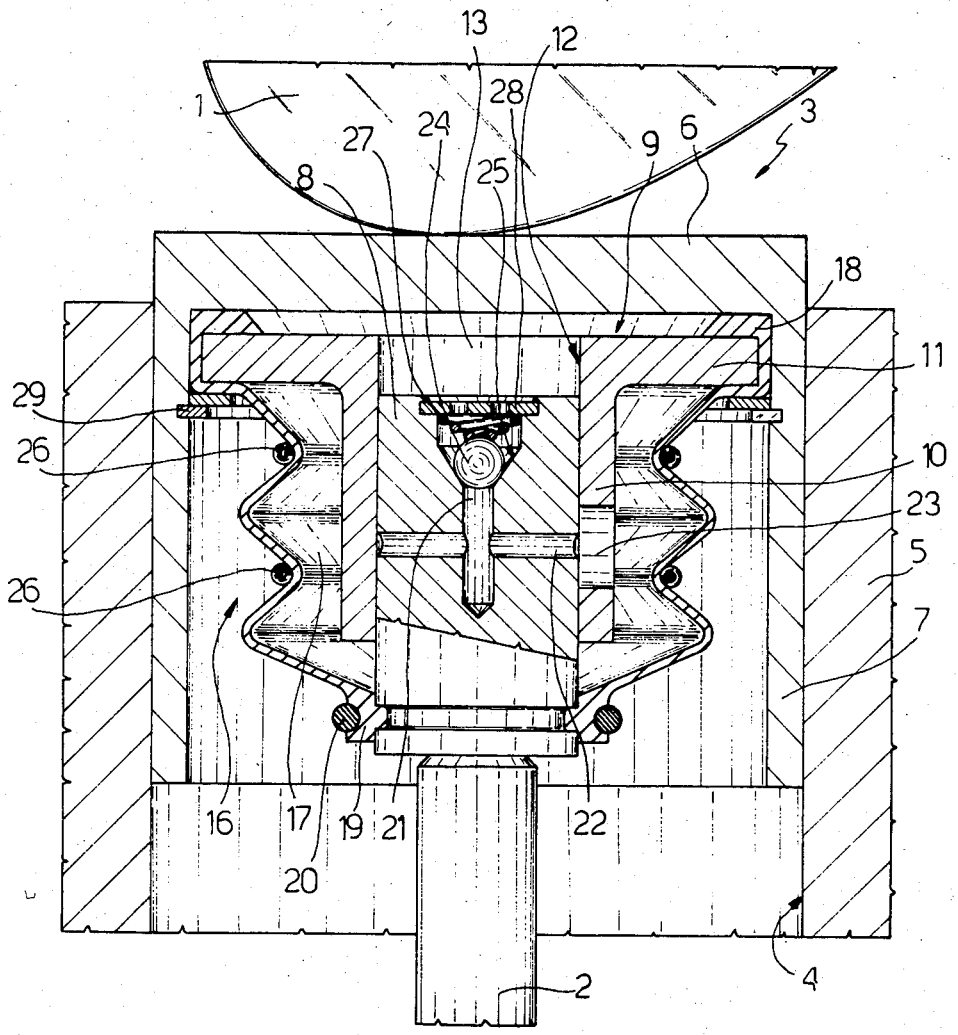
FIG. 3 shows an axial section of a second arrangement of the tappet according to the present invention.

The essential difference between the FIG. 3 arrangement and the one shown in FIGS. 1 and 2 lies in the design of a number of parts on the tappet. In particular, sleeve 10 on third annular member 9 is much higher than in the FIGS. 1–2 arrangement so as to enable it to house a second member 8 of considerable axial length. Consequently, flexible annular member 16 is also higher than in the FIGS. 1–2 arrangement and may comprise more than one rib. The FIG. 3 arrangement is also provided with a helical spring 27 designed to exert pressure on ball 24 and so keep it in permanent contact with seat 25. The said spring is located between the said ball and a disc 28 secured in any convenient manner inside a hole on second member 8, as shown clearly in FIG. 3.

The components on the FIG. 3 tappet also differ slightly as to a number of construction details, but with no effect on the overall design of the tappet itself. For example, in the FIGS. 1–2 arrangement, sleeve 10 on third annular member 9 is partially inserted inside a cylindrical cavity in bottom wall 6 on first cup member 3, a construction detail not found in the FIG. 3 arrangement. The tappet according to the present invention operates as follows.

At the manufacturing stage, the first and second chambers, 13 and 17, on the tappet are filled up with oil, presumably with the tappet arranged as shown in FIG. 1, i.e. maximum volume inside second chamber 17.

When the engine is started up with the tappet assembled on the gear train between cam 1 and stem 2, there is an immediate tendency for any slack between the tappet and other components to be taken up, owing to the oil inside second chamber 17 being kept under pressure by spring 26 and therefore tending to flow back through opening 23 and holes 22 and 21 into first chamber 13 which is filled up until first cup member 3 contacts cam 1.

When the engine is running, the oil inside first chamber 13 is prevented from flowing back through the said holes by ball 24 being thrust against seat 25 so as to close off the holes, thus eliminating any slack between cam 1 and stem 2 while the engine is running. When the engine is left idle for relatively long periods, oil may seep between the mating surfaces on sleeve 10 and member 8, thus enabling it to flow back from first chamber 13 into second chamber 17. As soon as the engine is started up, however, and even during the initial operating period with the oil pressure still low, any slack on the drive is efficiently taken up by the tappet owing to the oil pressure inside second chamber 17 being sufficiently high for oil to flow back through opening 3 and holes 22 and 21 into first chamber 13 and so establish contact between bottom wall 6 on first cup member 3 and cam 1 and between member 8 and stem 2.

Clearly, therefore, the tappet according to the present invention provides for correct operation even at low engine speed or just after start-up, in that the oil pressure inside second chamber 17 is always sufficient for oil to flow into first chamber 13. The tappet according to the present invention also provides for maximum reliability in that the hydraulic conditions established during manufacture remain essentially unchanged during operation. Any possibility of oil leakage from the tappet is safeguarded against by none of the sliding connections communicating externally, but only with second oil chamber 17.

Furthermore, the design of the tappet according to the present invention is straightforward and compact, thus enabling low-cost manufacture.

To those skilled in the art it will be clear that changes may be made to the arrangement shown without, however, departing from the scope of the present invention.

Firstly, the shape of flexible annular member 16 may be other than as described, and different flexible means may be provided for exerting radial pressure for flexing the said member and so keeping the fluid in chamber 17 essentially under pressure.

Secondly, the on-off means between the said two chambers may be other than as described. Thirdly, provision may conveniently be made, between second member 8 and bottom wall 6 on first cup member 3, for any type of spring, e.g. a flat spring, for parting the said member 8 from the said wall and setting them in the mutual position shown in FIG. 2.

We claim:

1. Hydraulic tappet designed for assembly on a drive for controlling a valve on an internal combustion engine, the said tappet comprising a first cup member having a bottom wall and a cylindrical side wall and sliding axially in relation to the engine frame, and a second member sliding axially inside the said first member; the said first and second members combining to form a first chamber varying in volume and having an inlet duct for activating fluid, the said duct being controlled by an on-off member in such a manner that the said fluid flowing into the said chamber causes one of the said members to slide axially in relation to the other so as to vary the volume of the said chamber; characterized by the fact that it comprises a third annular member having a sleeve, inside the inner bore of which the said second member slides axially, and a ring projecting radially from the said sleeve and connected in fluidtight manner to the said side wall on the said first cup member in such a manner as to form the said first chamber between the said ring and the said bottom and side walls on the said first cup member, and characterised by the fact that it comprises a fourth member made of flexible material and located essentially inside the said first cup member and outside the said sleeve on the said third annular member, the said fourth flexible annular member having a first and second annular edge connected in fluidtight manner respectively to the said ring on the said third member and to the side surface of the said second sliding member in such a manner as to form a second annular chamber for the said activating fluid connected hydraulically, via the said duct, to the said first chamber.

2. Hydraulic tappet according to claim 1, characterised by the fact that the said first edge on the said fourth annular member is also connected in fluidtight manner to the said side wall on the said first cup member.

3. Hydraulic tapper according to claim 2, characterised by the fact that the first edge on the said fourth annular member is located between the said ring on the said third member and the said side wall on the said first cup member.

4. Hydraulic tappet according to claim 1, characterised by the fact that it comprises flexible means designed normally to keep the said fourth flexible annular member in a flexed position whereby the volume of the said second chamber is minimum, thus causing the said activating fluid to flow from the said second to the said first chamber.

5. Hydraulic tappet according to claim 4, characterized by the fact that the said flexible means comprise at least one annular spring located outside the said fourth flexible annular member and designed to exert essentially radial pressure on the outer surface of the said fourth flexible annular member, so as to set the latter in the said flexed position.

6. Hydraulic tappet according to claim 1, characterized by the fact that the said inlet duct for activating fluid comprises at least a first axial and a second radial hole, formed in the said second sliding member, and a third hole formed in the said sleeve on the said third annular member; the said first hole having a seat for the said on-off member.

7. Hydraulic tappet according to claim 6, characterised by the fact that the said seat is tapered and the said on-off member consists of a ball.

8. Hydraulic tappet according to claim 1, characterised by the fact that the said fourth annular member of flexible material presents circumferential ribs designed to enable it to assume the said position whereby the volume of the said second chamber is minimum.

* * * * *